US008943778B2

(12) United States Patent
Bélanger

(10) Patent No.: US 8,943,778 B2
(45) Date of Patent: Feb. 3, 2015

(54) DRYWALL BACKING APPARATUS AND METHOD OF INSTALLING SAME

(71) Applicant: Ghislain Bélanger, Rivière des Prairies (CA)

(72) Inventor: Ghislain Bélanger, Rivière des Prairies (CA)

( * ) Notice: Subject to any disclaimer, the term of this patent is extended or adjusted under 35 U.S.C. 154(b) by 0 days.

(21) Appl. No.: 13/862,629

(22) Filed: Apr. 15, 2013

(65) Prior Publication Data

US 2014/0305071 A1 Oct. 16, 2014

(51) Int. Cl.
*E04B 2/00* (2006.01)
*E04B 2/74* (2006.01)

(52) U.S. Cl.
CPC ..... *E04B 2/7453* (2013.01)
USPC ..... 52/762; 52/655.1

(58) Field of Classification Search
USPC ..... 52/762, 317, 481.1, 655.1, 696, 715
See application file for complete search history.

(56) References Cited

U.S. PATENT DOCUMENTS

| | | | | |
|---|---|---|---|---|
| 4,658,556 | A * | 4/1987 | Jenkins | 52/317 |
| 5,692,341 | A * | 12/1997 | Erlandson | 52/27 |
| 7,331,149 | B2 * | 2/2008 | Tollenaar | 52/481.1 |
| 7,520,100 | B1 * | 4/2009 | Herrman et al. | 52/481.1 |
| 8,205,402 | B1 * | 6/2012 | Digirolamo et al. | 52/241 |

* cited by examiner

*Primary Examiner* — Jeanette E Chapman
*Assistant Examiner* — Daniel Kenny
(74) *Attorney, Agent, or Firm* — Equinox IP; Franz Bonsang, Patent Agent

(57) ABSTRACT

A drywall backing apparatus for metal studding consists of a two-limb backing member, with one limb extending orthogonal to the other to present a generally L-shaped form. The metal studding comprises a plurality of U-shaped studs, the flanges of which have overturned edges for engagement and registration with grooves in the backing member which bridges and is secured by fasteners to successive studs to provide suitable fixing for wall furniture.

7 Claims, 3 Drawing Sheets

DRYWALL BACKING APPARATUS AND METHOD OF INSTALLING SAME

CROSS-REFERENCE TO RELATED APPLICATIONS

This application is a Continuation-In-Part of, now abandoned, U.S. patent application Ser. No. 12/585,517, filed on Sep. 17, 2009 and published under Publication No. U.S. 2010/0126113 A1, which claimed benefit of U.S. Provisional Application for Patent Ser. No. 61/136,595, filed on Sep. 18, 2008, both of which being incorporated herein by reference.

FIELD OF THE INVENTION

The present invention relates to wall construction, and in particular to a method and an apparatus for anchoring wall mounted furniture such as handrails, grab bars, cupboards and other items.

BACKGROUND OF THE INVENTION

U.S. Pat. Nos. 6,705,056 and 7,133,149 disclose a method and an apparatus of anchoring in which backing members are provided for positive location in between successive spatially disposed U-shaped metal studs forming a wall structure, the backing members being interlinked by a hinge. The backing members are provided with grooves which selectively register with overturned edges of the stud flanges thereby giving a positive location for the backing members with hinges affording continuity longitudinally of the wall structure formed by the studding. The backing members, which may be of plywood, are marketed together with the hinge in suitable lengths such as to present an integral combination, which in use constitutes a continuous strapping lengthwise of the studding thus providing flexibility during installation, but rigidity when properly fixed in position by the use of suitable fasteners.

Although the prior art recited supra represents a valuable contribution in the building trade giving time-saving installation advantages together with the structural integrity demanded by appropriate codes, the combination of the backing members and the hinge is cumbersome in terms of packaging, storage and to some extent in handling.

Accordingly, there is a need for an improved system for the installation of metal studding and the provision of the requisite heavy-duty backing members for the attachment of wall-mounted furniture normally to be found in commercial and residential premises.

SUMMARY OF THE INVENTION

It is therefore a general object of the present invention to provide an improved apparatus for and method of providing backing members interstitially between successive studding in a wall structure composed of metal studs.

An advantage of the present invention is to facilitate installation of the backing members to the studding.

A further advantage of the present invention is that the apparatus can be installed horizontally and transversally between successive face-to-back wall studs, vertically and longitudinally along any one wall stud, and horizontally and transversally between successive face-to-face wall studs.

Another advantage of the present invention is to provide apparatus which, when installed correctly, confers on the assembled studding a rigidity, straightness and strength that enable the application of plasterboard sheeting in a uniform plane.

A still further advantage of the present invention is that the apparatus now proposed provides elements that can be easily packaged, stored, handled, and secured to metallic wall studs, for reliable attachment thereto.

Another advantage of the present invention is to provide a kit of parts that can be marketed for both the commercial and DIY (Do-It-Yourself) sectors.

According to a first aspect of the present invention there is provided a backing member for horizontal or vertical installation in-between successive U-shaped metal studs forming part of a wall structure, the backing member comprising a generally planar first bridging limb having at a free first end thereof a first groove for registration with at least a flange of the metal stud, the first groove extending across a face of the first limb substantially parallel to and adjacent an edge of the free end of the first limb, and a second limb in the form of a bracing block extending orthogonally from the first limb at a second end thereof opposite the first end and secured to the second end, the second limb being dimensioned to engage a web of the stud internally or externally thereof, the first and second limbs in use extending in-between successive metal studs and being securable thereto by fasteners, wherein a second groove extending across said face of the first limb orthogonally with respect to the first groove and in parallel with another edge of the first limb extending between the first and second ends thereof, said second groove further extending across a second face of the second limb being in a coplanar relationship to said face of the first limb.

The primary intention of the backing member is to extend horizontally in-between and brace successive metal studs. However, in an alternative usage of the backing member, it may be disposed vertically at a marginal part of a single stud for securement to a flange thereof and for this purpose the backing member is provided with the second groove for registration with said flange, the second groove being arrayed orthogonally to the first-mentioned groove. This alternative usage may be of advantage for the fixing of certain room or office wall furniture.

A third registration groove may be provided on the backing member and extends parallel to the first-mentioned formation, the first and third formations being spaced apart a distance corresponding to the spacing of the flanges of successive studs facing each other. The third registration formation may be formed in the second limb. The backing member may conveniently be produced from wood, which may be of laminated form.

The studs are provided with flanges having turned-over edges which in use present detents to engage one or more of the said formations to afford positive location of the backing member in relation to the studs.

The formations are conveniently in the form of grooves for registration with and reception of turned-over edges or lips of the stud flanges.

It is to be understood that the backing members are securely fastened to the studs by the use of approved fasteners, generally threaded fasteners.

According to a second aspect of the present invention there is provided a kit of parts including a plurality of backing members each produced according to the first aspect of the present invention.

According to a third aspect of the present invention there is provided a method of providing at least one backing member between two successive vertically erected U-shaped metal studs constituting studding in a wall structure, each said stud being installed with the web thereof secured to an end abutment and its front and back flanges forming the open mouth of the stud facing along the studding, with said two studs being oriented in a wall direction with the flanges of a first one of the studs being oriented toward a second one of the studs, each flange of each stud being turned-over to provide marginal lips in the form of detents, each backing member employed being made in accordance with the first aspect of the present invention, the method including the steps of:

a—inserting the backing member in-between the two successive studs with the second limb abutting the external surface of the web of the second stud and a free end of the first limb abutting the internal surface of the front flange of the first stud, the at least one formation registering with the detent of the front flange of the first stud; and b—securing the backing member to both the first and second studs by the use of fasteners passing through the front flange of the first stud into the backing member and through the web of the second stud into the backing member.

Conveniently, the studding includes a third vertically erected U-shaped metal stud adjacent the second stud and being oriented in the opposite sense relative to the first and second studs with the flanges of the third studs being oriented toward the second stud, the at least one backing member being a first backing member and the at least one registration being a first registration adjacent the free end of the first limb thereof, a second backing member having a third registration formation being generally parallel to the first formation and located adjacent the second limb, the method further including the steps of:

c—inserting the second backing member in-between the second stud and the third stud with the free end of the first limb abutting the internal surface of the front flange of the second stud with the first formation registering with the detent of the front flange of the second stud and the second limb abutting the front flange of the third stud with the third formation registering with the detent of the front flange of the third stud; and d—securing the second backing member to both the second and third studs by the use of fasteners passing through the front flange of the second and third studs into the second backing member.

The invention also includes a wall structure produced by the method and incorporating a plurality of backing members secured to a plurality of studs, the combination constituting studding to which a plasterboard is secured.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiment of the present invention will be herein described for indicative purpose and by no means as of limitation.

Figure 1:
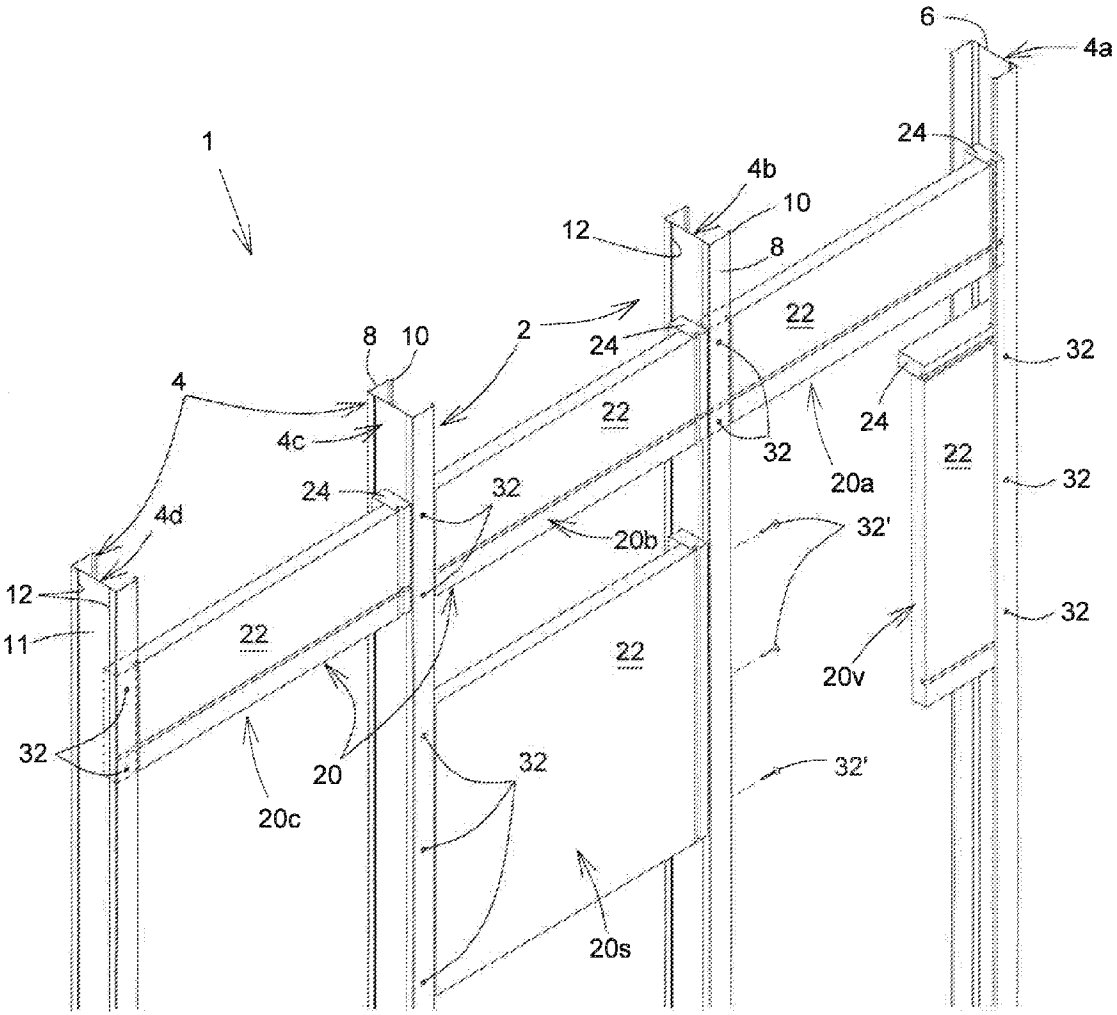
FIG. 1 is a perspective front elevation of a section of studding in a wall structure showing backing members in accordance with an embodiment of the present invention emplaced in-between successive studs.

FIG. 1 illustrates a section 1 of studding 2 forming part of a wall structure (not shown), the studding 2 being comprised of a plurality of metal U-shaped studs 4 each having a web 6 with flanges 8 extending orthogonally therefrom with overturned edges or lips 10 essentially parallel to the web 6. Whilst the internal surface of the web 6 is substantially flat, its corresponding external surface 11 is slightly recessed in its central portion as at 12. The proximal stud 4*a* is typically secured to an end abutment 13 (FIG. 2) with its surface 11 interfacing therewith and the open mouth of the stud facing along the length of the studding 2, the successive studs 4 being oriented as shown in the opposite sense, up to a last and final distal stud (not shown) of the wall construction. Backing members 20 extend between and are positively located in relation to the studs 4 in a manner to be described below.

Figure 2:
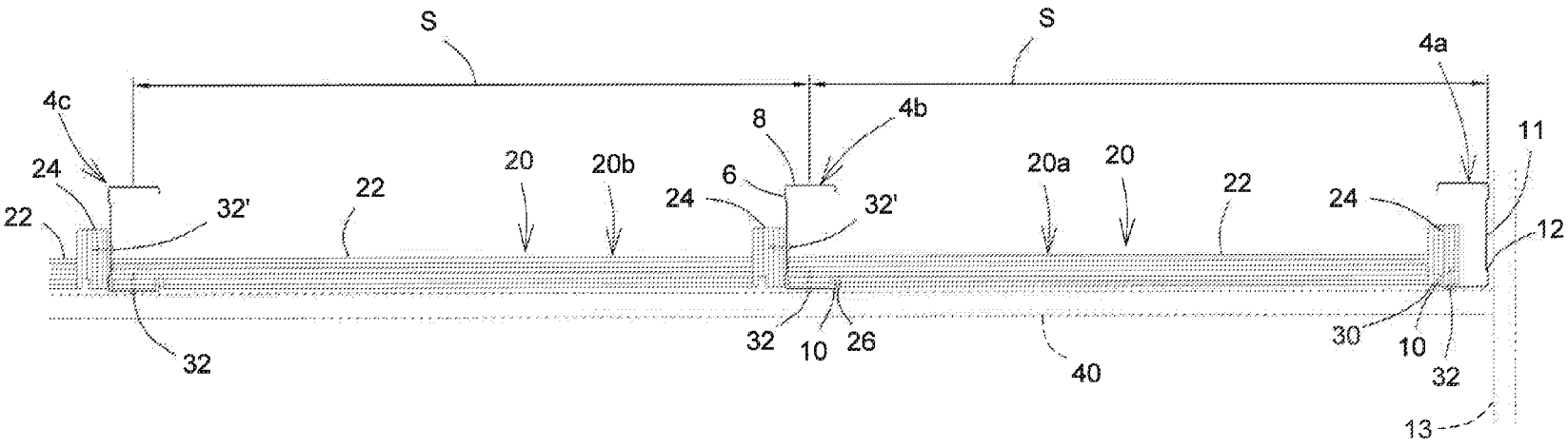
FIG. 2 is a partially broken plan view of the studding shown in FIG. 1.
Figure 3:
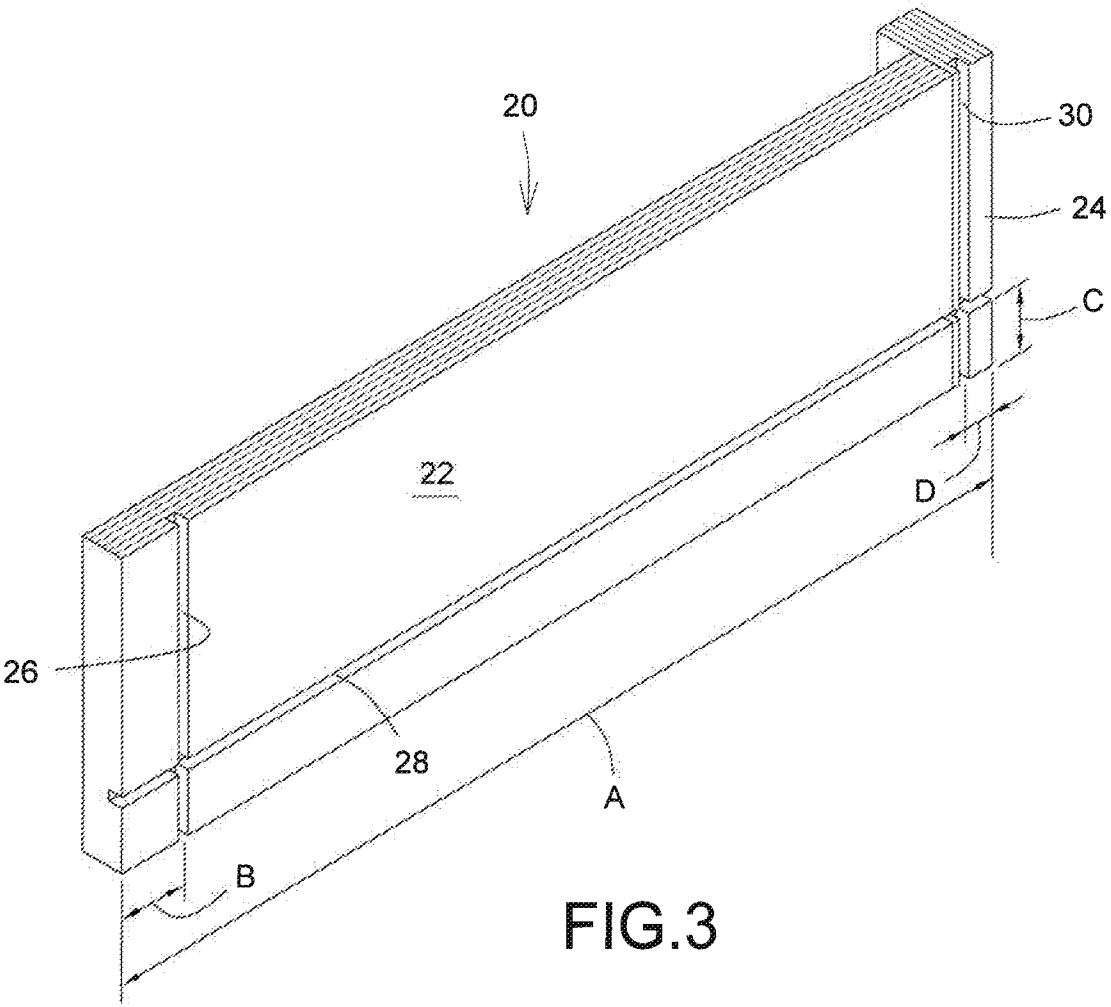
FIG. 3 is a perspective front elevation of the embodiment of FIG. 1.

Referring now to FIG. 3, a backing member 20 is depicted and comprises a first limb 22 and a second limb 24 extending substantially orthogonally therefrom at one end of the first limb 22 to give a generally L-shaped appearance of its cross-section. The first limb 22 has a first registration formation or groove 26 (or channel) extending across its width and opening into both edges and a second groove 28 extending lengthwise and intersecting the first groove 26 and a third groove 30 formed in the second limb, the first and third grooves being parallel one to the other or substantially so. The second groove 28 extends across both first 22 and second 24 limbs, and typically intersects both first 26 and third 30 grooves. The backing member 20 in this example of the present invention is of laminated form and is of the appropriate ply to comply with building codes, including its length dimension to substantially fit standard construction stud spacing(s) S (see FIG. 2), between successive face-to-back studs. The first and second limbs of the backing member 20 are typically securely attached to one another by staples or the like attachment, optionally with an adhesive there between. The backing member is conveniently produced from wood, which may be of laminated form of typically ¼ inch thick (as illustrated in FIGS. 2 and 3), and could preferably be pre-treated with afire-retardant. The second limb 24 provides for a relatively wider surface to abut the web 6 of the adjacent stud 4 than the thickness of the first limb 22. Furthermore, the presence of the second limb 24 prevents a possible delamination, and therefore unreliable securing, that could occur if a screw would directly penetrates into the edge surface of the first limb 22, within the plane thereof, in between adjacent layers of the laminate.

As shown in FIG. 3, typically, the overall length A of the backing member 20 is, in English units, an eighth of an inch (⅛") smaller than the stud spacing S. for example 15⅞ inches for a stud spacing S of 16 inches. The distances B, C, D of the center of the respective first 26, second 28 and third 30 grooves to the corresponding close edge of the backing member 20 are typically 1⅛", ⅝", and 1⅛", respectively, while the typical groove width is about ⅛". The width dimension of the backing member 20 may considerably vary depending of the intended use and expected load support. To this end, a substantially square shape backing member 20*s* is illustrated in FIG. 1.

Although a different and less convenient installation order could be considered, the first backing member 20 to be installed is typically the leftmost one 20*c*, in the present case of FIG. 1, simply for ease of installation. Then the following backing members 20 are successively installed the same way in-between successive studs 4.

For the last but one backing member 20*b*, the second limb 24 abuts the external surface 11 of the second stud 4*b* as can be seen in FIG. 2, typically in register with the front flange 8 thereof, and is secured thereto by means of screws 32 or the like extending through the web 11 into the backing member 20*b*, whilst the first limb 22 extends into the open mouth of the third stud 4*c* with the lip 10 of the front flange 8 interengaging and registering with the first groove 26, with the end of the first limb 22 typically abutting the internal surface of the web 6. The first limb 22 receives a screw 32' or the like extending through the front flange 8.

In use with the proximal stud 4*a* being oriented as shown (in a face-to-face relationship with the second stud 4*b*), the first backing member 20*a* is finally (when other backing members 20*b*, 20*c* were previously installed) inserted in-between that first proximal stud 4*a* and the second, successive stud 4*b* in the studding 2. As can be seen more particularly in FIG. 2, the third groove 30 is caused to register with the lip 10 of the front flange 8 of the stud 4*a*, the lip forming a detent for positively locating the backing member 20*a* on the stud 4*a*. At the other end of the backing member 20*a*, similarly to the installation of previous backing members 20*b*, 20*c*, the first groove 26 is caused to engage the lip 10 of the front flange 8 of the second stud 4*b* with the end of the first limb 22 typically abutting the internal surface of the web 6 of stud 4*b*. The limbs 22 and 24 are secured to the respective studs 4*a* and 4*b* by means of screws 32 or the like extending through the respective flanges 8 into the backing member 20*a*.

As it would be obvious to one skilled in the art, only the first backing member 20*a* could be installed between the first and second studs 4*a*, 4*b*, without having to previously install any other adjacent backing members 20.

Typically, at the end, all studs 4 are braced one to the other with the backing members 20 provided for wall furniture fixtures and fittings, placed on a plasterboard 40 (FIG. 2) secured to the studding 2.

If it should be desired to provide a backing member 20*v* in a vertical orientation as can be seen in FIG. 1 on the proximal stud 4*a*, the second groove 28 is caused to engage the lip 10 on the front flange 8 of the stud 4*a* and screws 32 are applied through that flange into the backing member 20*v* to secure the latter in position as shown.

The backing member of the present invention is of such dimension as to be easily packaged and thus stored. Accordingly, the invention may be supplied in kit form to the extent that suitable fasteners may be included thereby enabling a user to apply the backing member to pre-erected metal studding in a simple and swift manner, obviating the need for complicated strapping arrangements. The versatility of the invention in terms of its orientability in either the horizontal or the vertical mode is an added advantage.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A backing member for horizontal or vertical installation in-between successive U-shaped metal studs forming part of a wall structure, the backing member comprising a generally planar first bridging limb having at a free first end thereof a first groove for registration with at least a flange of the metal stud, the first groove extending across a face of the first limb substantially parallel to and adjacent an edge of the free end of the first limb, and a second limb in the form of a bracing block extending orthogonally from the first limb at a second end thereof opposite the first end and secured to the second end, the second limb being dimensioned to engage a web of the stud internally or externally thereof, the first and second limbs in use extending in-between successive metal studs and being securable thereto by fasteners, wherein a second groove extending across said face of the first limb orthogonally with respect to the first groove and in parallel with another edge of the first limb extending between the first and second ends thereof, said second groove further extending across a second face of the second limb being in a coplanar relationship to said face of the first limb.

2. The backing member according to claim 1 wherein each of said first and second grooves is adapted for registration with an edge of said flange of the metal stud.

3. The backing member according to claim 1 wherein a third groove is provided on the second limb in the second face of the second limb, the third groove extending in substantial parallelism with the first groove on the first limb.

4. The backing member according to claim 3 wherein the second third groove extends into and across the second face of the second limb.

5. The backing member according to claim 3 wherein a spacing between the first and third grooves is generally equal to a spacing of the respective flanges of two adjacent said studs.

6. The backing member according to claim 3 wherein each of said first, second and third grooves extends into a marginal edge of the respective limb.

7. The backing member according to claim 1 wherein the first and second limbs provide a generally L-shaped appearance to a cross-section of said backing member.

* * * * *